United States Patent [19]

Fourché et al.

[11] Patent Number: 4,538,128

[45] Date of Patent: Aug. 27, 1985

[54] DEVIATOR FOR AN AUTO CONVERGENT COLOR PICTURE TUBE AND ITS METHOD OF MANUFACTURE

[75] Inventors: Jean-Pierre Fourché, Marsaunay la Cote; Marc Milili, Dijon, both of France

[73] Assignee: Videocolor, Montrouge, France

[21] Appl. No.: 538,053

[22] Filed: Sep. 30, 1983

[30] Foreign Application Priority Data

Oct. 5, 1982 [FR] France ..... 82 16680

[51] Int. Cl.[3] ..... H01F 7/00

[52] U.S. Cl. ..... 335/210; 335/212; 313/421

[58] Field of Search ..... 313/421, 426, 427, 428, 313/431; 335/210, 212

[56] References Cited

U.S. PATENT DOCUMENTS

| | | | |
|---|---|---|---|
| 2,763,804 | 12/1953 | Morrell | 313/431 |
| 3,831,051 | 8/1974 | Ohgoshi et al. | 313/421 |
| 4,231,009 | 10/1980 | Barkow | 335/212 |
| 4,237,437 | 12/1980 | Vink et al. | 335/213 |
| 4,242,612 | 12/1980 | Heijnemans et al. | 313/421 |
| 4,272,727 | 6/1981 | Nieuwendijk et al. | 335/213 |
| 4,409,578 | 10/1983 | Beelaard et al. | 335/212 |

FOREIGN PATENT DOCUMENTS

| | | | |
|---|---|---|---|
| 2029089 | 3/1980 | United Kingdom | 335/213 |
| 2079527 | 1/1982 | United Kingdom | 313/421 |

*Primary Examiner*—George Harris

*Attorney, Agent, or Firm*—Pollock, VandeSande & Priddy

[57] ABSTRACT

A deviator associated with an autoconvergent color image tube is modified so that it may be used in combination with a tube of the same type, but having an image screen of smaller size, the horizontal and/or vertical deviation center being displaced. According to the invention, a magnetic screen is placed across the magnetic field lines produced by the vertical and horizontal deviation coils whereby the deviation centers are displaced without any modification of the coils.

5 Claims, 10 Drawing Figures

FIG. 5
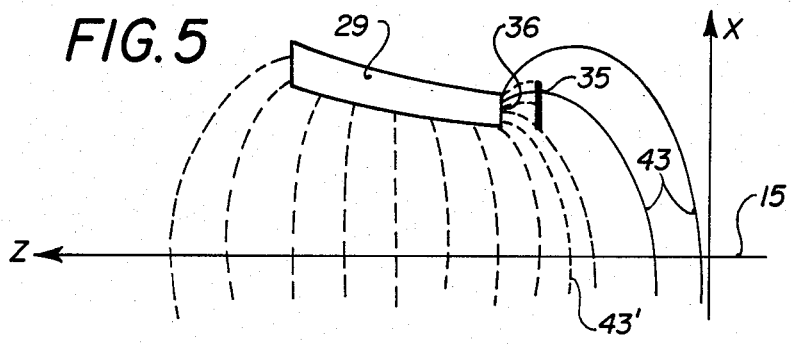
FIG. 6
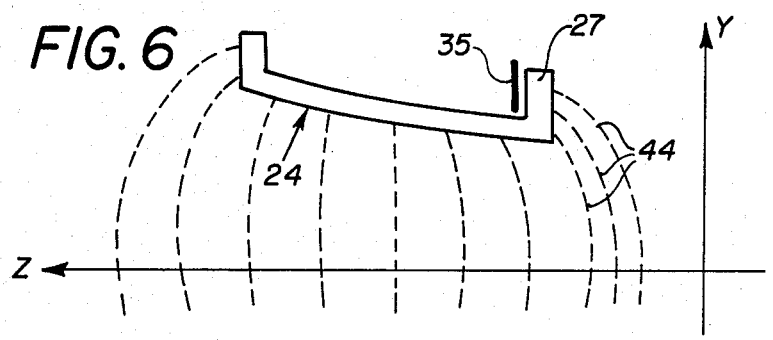
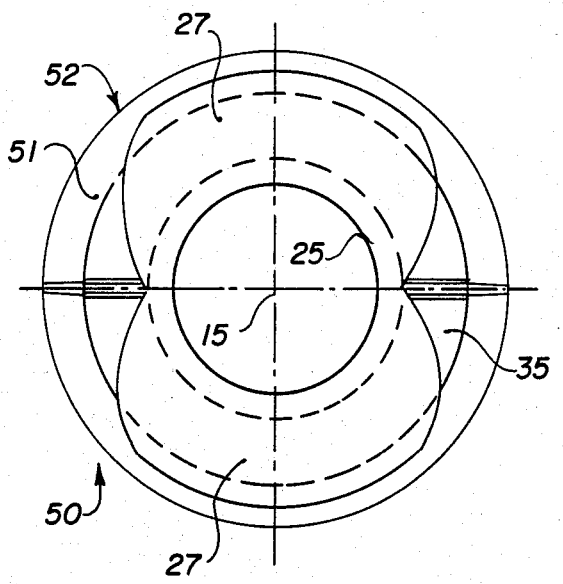
FIG. 7
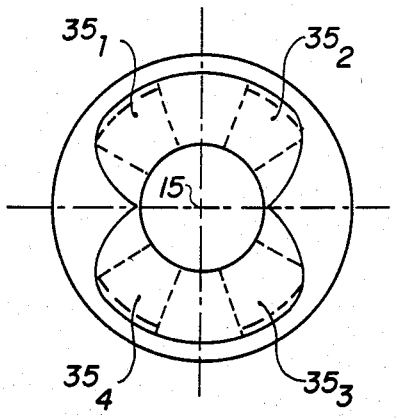
FIG. 8

DEVIATOR FOR AN AUTO CONVERGENT COLOR PICTURE TUBE AND ITS METHOD OF MANUFACTURE

BACKGROUND OF THE INVENTION

The invention is related to a process of modifying a color image tube deviator, especially a deviator associated with a tube comprising three coplanar guns, wherein the combination of tube and deviator assembly is autoconvergent. The deviator, while retaining its autoconvergent property, may be associated with a family of tubes having different dimensions but the same deflection angle.

It is known that a color television image tube comprises three electron guns each one of which is adapted to excite on the screen a luminescent substance of a given color, i.e. red, green or blue. At every moment these three beams impact with a triplet of three luminescent substances on the screen. The displacement or shifting of these three electron beams is achieved by means of a deviator mounted on the neck of the tube and comprising two coils through each one of which flows an alternating electric current generating a variable magnetic field for deviating said electron beams. One of said coils provides for the horizontal sweep, i.e. line sweep, of the screen, while the other coil ensures the vertical sweep or field sweep.

It is easily understood that the design and adjustment of the coils or windings of a deviator are difficult operations, since the three electron beams must converge on the screen at every point thereof, and each beam must be focalized on the center of the screen, while the tube has not a rotationally symetric shape, the screen having substantially flat or planar configuration, and the guns producing beams located in one common plane. Thus, with a view to adjusting an autoconvergent tube plus deviator assembly, a compromise has to be established between a certain number of contradictory requirements. Therefore a deviator designed for a tube of a given type and having given dimensions will not be convenient for use with a tube of a different type and/or having different dimensions.

However it has already been noted that one given deviator may be used in association with two autoconvergent tubes which differ from each other only in the size of the screen (and thus also in the length of the conical portion), provided that the distance between the line deviation center and the field deviation center is modified with a view to reducing the anisotropic astigmatism (cause of deficiency of convergence between horizontal lines). For achieving such modification, it has been current practice up to now to displace axially one coil with respect to the other, or to vary the length of each coil.

SUMMARY AND OBJECTS OF THE INVENTION

The invention allows still further to simplify the modification of an autoconvergent tube deviator for adapting the same to a tube having a smaller size.

With this object in view, the invention provides a process of the kind initially defined herein-above, which comprises the step of placing a magnetic element, such as a magnetic screen, across the magnetic field lines produced by the coils, so as to vary the distance between the vertical and horizontal deviation centers.

It is thus not necessary to modify or displace the coils.

When the deviator is of the so-called "saddle-annular" type comprising a horizontal deviation coil in the form of a saddle having coil napes at its front and rear ends, respectively, which extend in respective planes perpendicular to the axis of the tube, and between which is located the annular vertical deviation coil, the magnetic screen may be placed between the rear nape of the horizontal deviation coil and the rear face of the vertical deviation coil.

In the case of a so-called "saddle-saddle" type deviator wherein the vertical deviation coil as well as the horizontal deviation coil have the shape of a saddle comprising front and rear napes, the magnetic screen is placed, for example, between the respective rear napes of said two coils.

In both cases mentioned herein-above the magnetic screen modifies the magnetic field lines in such a manner that the vertical deviation center is displaced forwardly (toward the tube screen), while the horizontal deviation center is displaced rearwardly (toward the guns).

Further objects, features and advantages of the invention will become apparent from the following description of several embodiments of the invention, which is given with reference to the appended drawings, and by way of illustration, but not of limitation.

BRIEF DESCRIPTION OF THE DRAWINGS

In the drawings:

FIGS. 3 to 6 are diagrams and schematic views of magnetic fields and field lines corresponding to the deviator shown in FIG. 2.

FIG. 7 is an elevational rear view of the deviator shown in FIG. 2.

FIG. 8 is a view similar to that of FIG. 7, showing a modified embodiment.

DESCRIPTION OF THE PREFERRED EMBODIMENTS

Figure 1:
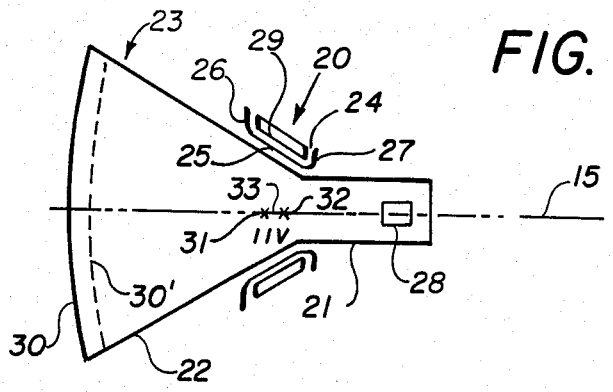
FIG. 1 is a schematic general view of a television tube comprising a deviator and electron guns.

In the example shown, the color image tube-plus-deviator assembly is of the autoconvergent type; the tube comprises electron guns producing coplanar beams, and a mask provided with elongated or oblong holes. Deviator 20 is mounted around the neck 21 and the conical portion 22 of tube 23, said conical portion being integrally connected to the neck. The deviator comprises a horizontal deviation or deflection coil 24 having the shape of a saddle including a central portion 25 fitting the profile of tube portion which it surrounds, and end napes 26 and 27, respectively, which are located in respective planes perpendicular to the axis 15 of the tube.

The function of coil 24 consists in producing a magnetic field which displaces horizontally the electron beams produced by three electron guns 28 provided within the tube.

Another coil 29 having an annular shape and a substantially rectangular cross section is wound on a core made of ferromagnetic material, such as ferrite, and surrounds coil 24 between the front nape 26 and the rear nape 27. Coil 29 ensures the vertical displacement of the beams produced by guns 28.

Figure 3:
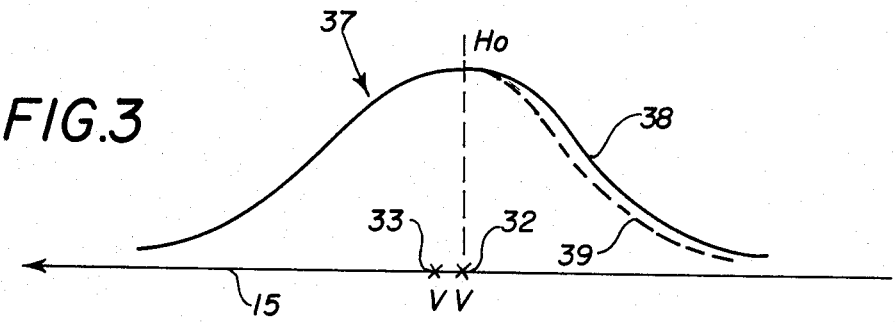
Figure 4:
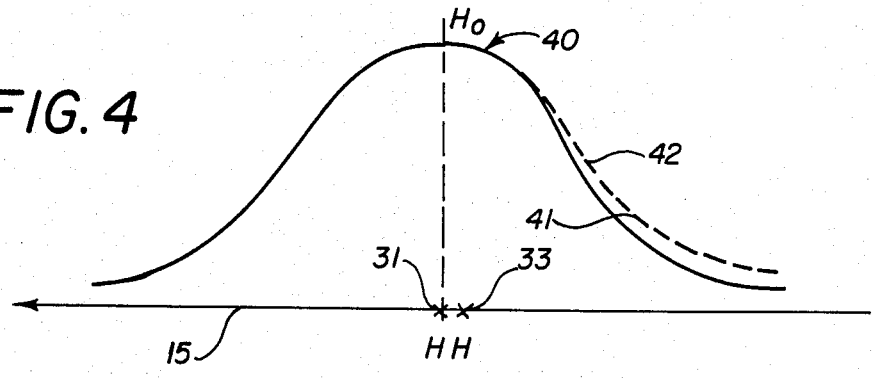

In the case of a large size tube wherein the diagonal of the screen 30 has a length of 67 cm, horizontal deflection coil 24 has a deflection center 31 on axis 15, which is seperated from vertical deflection, or field deflection, center 32 of coil 29 by a distance of several millimeters (FIGS. 3 and 4). Horizontal deflection center 31 is nearest to screen 30.

In case a color image tube has a screen 30' (FIG. 1) of smaller size than that of screen 30 and a diagonal length of 56 cm, while its other characteristics are the same as those of the previously described tube, to wit : identical guns 28, identical diameter and length of neck 21, identical corner angle of the conical portion 22, the horizontal and vertical deflection centers of the deviator must substantially coincide or be located at a very small distance from each other. The common horizontal and vertical deflection center 33 of a deviator associated with a tube screen 30' which has a diagonal length of 56 cm must be located between the horizontal deflection center 31 and the vertical deflection center 32. In other words, as compared to the tube with a screen having a diagonal of 67 cm, the tube having a screen with a diagonal of 56 cm has a horizontal deflection center of its deviator that is comparatively close to the guns, and a vertical deflection center of said deviator, which is comparatively remote from said guns.

With a view to allowing the horizontal and vertical deflection centers to be thus displaced without modifying either the relative position of the configuration of the deviator coils 20, the invention provides placing a magnetic screen 35 (cf. FIG. 2)—for example, as in the embodiment shown—between the rear nape 27 of saddle-shaped horizontal deflection coil 24 and the rear portion 36 of annular vertical deflection coil 29.

This magnetic screen is made of a material having a high magnetic permeability—higher than 1—, such as mumetal.

FIG. 3 is a diagram showing the variations, along axis 15, of the magnetic field $H_o$ produced by vertical deflection coil 29.

Curve 37 in full line corresponds to the magnetic field in the absence of screen 35. Vertical deflection center 32 is the projection on axis 15 of the center of gravity of the surface delimited by said curve 37 and axis 15.

Figure 2:
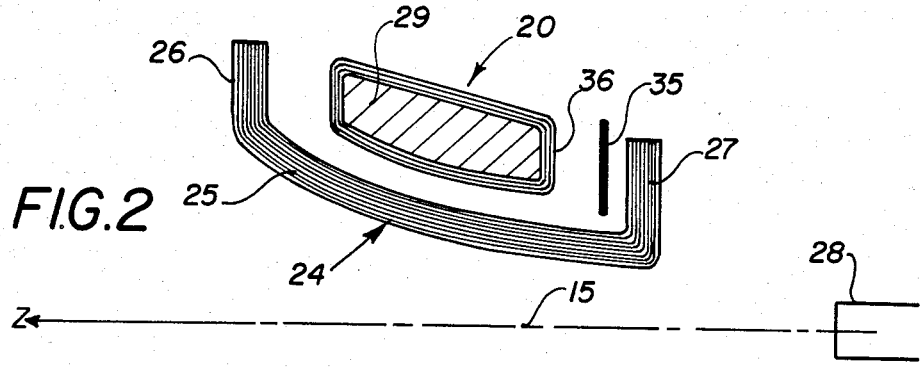
FIG. 2 is a half-split view showing in axial section a deviator according to the invention and electron guns.

When screen 35 is disposed as shown in FIG. 2, the rear portion 38 of curve 37 is displaced forwardly (i.e. toward the screen) and becomes curve 39 in dashed line. Under these conditions the vertical deviation (deflection) center is displaced forwardly.

FIG. 4 is a diagram similar to that of FIG. 3, but shows the variations, along axis 15, of the magnetic field $H_o$ produced by horizontal deviation coil 24. Curve 40 in full line corresponds to the conditions prevailing in the absence of magnetic screen 35. Under these conditions the horizontal deviation center of deviator 20 is located at point 31. When magnetic screen 35 is installed, the rear portion 41 of curve 40 is displaced rearwardly, thus becoming curve 42 in dashed line. Under such conditions the horizontal deviation center is displaced rearwardly toward point 33.

FIG. 5 schematically shows vertical deviation coil 29 and the magnetic field lines produced by the same, in the horizontal plane (plane ZX). It can be seen that the field lines in the proximity of magnetic screen 35 and rear portion 36 of annular coil 29 are deviated from their initial path 43 and displaced forwardly (at 43') due to the mirror effect produced by said magnetic screen 35, which explains the displacement of the vertical deviation center (FIG. 3).

FIG. 6 is a scheme similar to that shown in FIG. 5, but relates to horizontal deviation coil 24. In this case the field lines 44 behind magnetic screen 35 are thrust still further backwardly, which explains the conversion of curve 41 into curve 42 in FIG. 4 and the displacement of the horizontal deviation center upon inserting said screen 35 between nape 27 and rear portion 36 of coil 29.

It is important to note that the quality of the image obtained on the screen of the tube depends on the shape, the dimensions and the position of magnetic screen 35. In other words, screen 35 constitutes a complementary means for adjusting the tube. Such adjustment is achieved by modifying the position and/or dimensions and/or configuration of said screen 35. It will be understood furthermore that screen 35 increases the horizontal deflection and decreases the vertical deflection. As a result of this the feeding energy of the horizontal deflection coil is comparatively lower, while the feeding energy of the vertical deviation coil is comparatively higher.

In the example shown in FIG. 7, magnetic screen 35 comprises two parts constituting the two halves of a crown extending in a plane perpendicular to axis 15, and surrounding substantially entirely said axis.

In this example the deviator comprises, in a manner known per se, a casing 50 made of plastic material defining a central cylindrical hole adapted to receive neck 21, the main portion 25 of horizontal deviation coil 24 being located within said hole. The vertical deviation coil surrounds said casing. Rear nape 27 is applied against the rear face 51 of an end crown, or flange, 52 of casing 50. Coil 29 (not visible in FIG. 7) is located on the other side (with respect to nape 27) of crown 52. Magnetic screen 35 is disposed between nape 27 and rear face 51 of crown 52. Its construction in two parts is meant to allow said screen to be mounted in place.

In the embodiment shown in FIG. 8, magnetic screen 35 is constituted by four segments $35_1$, $35_2$, $35_3$ and $35_4$ of a crown which are distributed regularly about axis 15, each segment being shaped and positioned in such a manner that the bisectrix of the quadrant which it occupies constitutes a symmetric axis of said segment.

Figure 9:
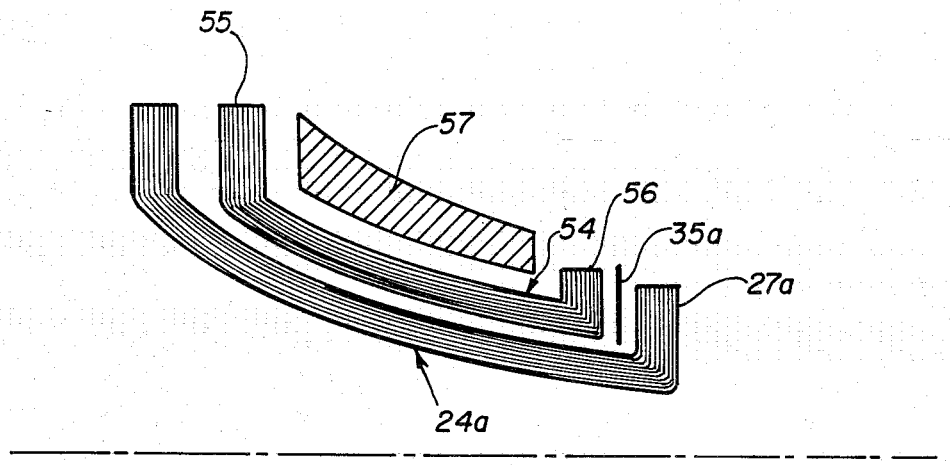
FIG. 9 is a view similar to that of FIG. 2, showing a different embodiment.

In the variant of FIG. 9, horizontal deviation coil $24_a$ is identical with coil 24 shown in FIG. 2. However vertical deviation coil 54 has the shape of a saddle similar to that of coil $24_a$. This coil 54 is shorter than coil $24_a$; it surrounds this latter coil and has a front nape 55 and a rear nape 56 both of which extend perpendicularly to the axis of the tube. Magnetic screen $35_a$ is placed between rear nape $27_a$ of coil $24_a$ and rear nape 56 of coil 54. A ferrite core 57 is disposed between napes 55 and 56 around the central portion of coil 54.

Figure 10:
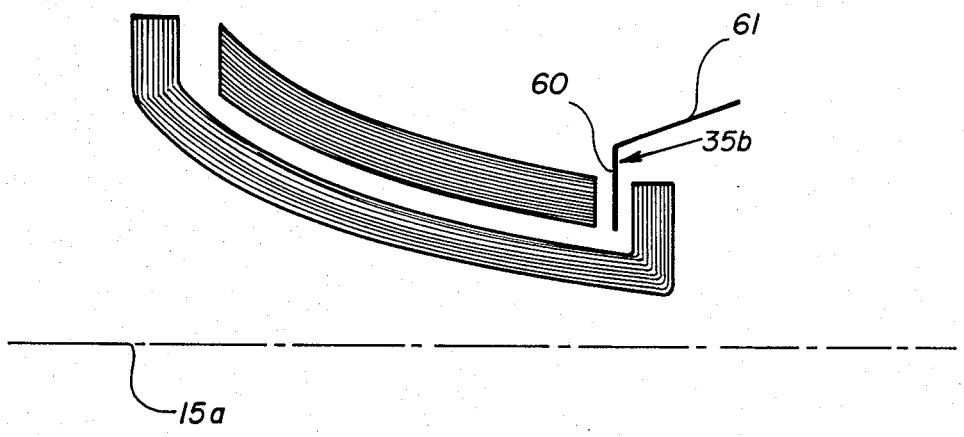
FIG. 10 is also a view similar to that of FIG. 2, showing yet another embodiment.

In the embodiment shown in FIG. 10, magnetic screen $35_b$ comprises a portion 60 perpendicular to axis 15, and a rear extension 61 extending obliquely toward the guns. This extension results in increasing the magnetic horizontal deviation field in a more substantial manner than a simple crown 35 or $35_a$ does.

The invention is not only directed to a deviator comprising a magnetic screen, but also to the assembly comprising an image tube and such deviator including a magnetic screen.

The invention is not limited to the embodiments shown and described herein-above; many modifications and variants can be envisaged by those skilled in the art, without departing from the spirit and scope of the invention as defined in the appended claims.

What is claimed is:

1. In autoconvergent color image tubes having differently sized tube screens, an interchangeable deviator assembly for use in any of the tubes, the assembly comprising:

a saddle-shaped horizontal deviation coil having front and rear napes being generally perpendicular to the axis of the tube;

a vertical deviation coil positioned in radially outward concentric relation to the horizontal deviation coil; and a magnetic screen positioned generally perpendicular to the tube axis, between the rear nape of the horizontal deviation coil and a confronting surface of the vertical deviation coil for (a) deviating magnetic lines of force from the vertical deviation coil, in the vicinity of the magnetic screen, forwardly toward the tube screen;

(b) deviating magnetic lines of force from the horizontal deviation coil, in the vicinity of the magnetic screen, rearwardly away from the tube screen;

the inclusion of the magnetic screen resulting in a displacement of the horizontal and vertical deviation centers to effect accurate vertical and horizontal deviation for the tubes having differently sized tube screens without necessitating modifications to the horizontal or vertical deviation coils.

2. The structure set forth in claim 1 wherein said magnetic screen comprises two parts constituting the two halves of a circular crown.

3. The structure set forth in claim 1 wherein said magnetic screen comprises a plurality of crown sectors.

4. The structure set forth in claim 2 or 3 wherein said crown comprises a first portion perpendicular to the axis of said tube and a second portion which is inclined with respect to said first portion.

5. A process for assembling an interchangeable deviator assembly for autoconvergent color image tubes having differently sized tube screens, the process comprising the steps:

positioning a saddle-shaped horizontal deviation coil around a conical section of the tube envelope and coaxial therewith, the coil having front and rear napes being generally perpendicular to the axis of the tube;

positioning an annular vertical deviation coil radially outward and in concentric relation to the horizontal deviation coil;

positioning a magnetic screen generally perpendicular to the tube axis between a rear nape of the horizontal deviation coil and a confronting surface of the vertical deviation coil for (a) deviating magnetic lines of force from the vertical deviation coil, in the vicinity of the magnetic screen, forwardly toward the tube screen; and (b) deviating magnetic lines of force from the horizontal deviation coil, in the vicinity of the magnetic screen, rearwardly away from the tube screen;

the inclusion of the magnetic screen resulting in a displacement of the horizontal and vertical deviation centers to effect accurate vertical and horizontal deviation for the tubes having differently sized tube screens without necessitating modifications to the horizontal or vertical deviation coils.

* * * * *